US012600545B2

(12) United States Patent
Baker et al.

(10) Patent No.: US 12,600,545 B2
(45) Date of Patent: Apr. 14, 2026

(54) TRAYS, PALLETIZED TRAY, BLANKS AND METHOD FOR FORMING A TRAY

(71) Applicant: WestRock Shared Services, LLC, Atlanta, GA (US)

(72) Inventors: Anthony S. Baker, Melbourne, KY (US); John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 18/274,890

(22) PCT Filed: Jan. 29, 2022

(86) PCT No.: PCT/US2022/014465
§ 371 (c)(1),
(2) Date: Jul. 28, 2023

(87) PCT Pub. No.: WO2022/165289
PCT Pub. Date: Aug. 4, 2022

(65) Prior Publication Data

US 2024/0308744 A1 Sep. 19, 2024

Related U.S. Application Data

(60) Provisional application No. 63/143,685, filed on Jan. 29, 2021.

(51) Int. Cl.
*B65D 71/62* (2006.01)

(52) U.S. Cl.
CPC .. *B65D 71/004* (2013.01); *B65D 2571/00141* (2013.01); *B65D 2571/0029* (2013.01);
(Continued)

(58) Field of Classification Search
CPC .. B65D 71/00; B65D 71/0029; B65D 71/004; B65D 2571/00141; B65D 2571/0029;
(Continued)

(56) References Cited

U.S. PATENT DOCUMENTS 1,995,280 A * 3/1935 Everhart ..... B65D 71/0055 229/117.14
2,373,851 A * 4/1945 Potter ..... B65D 71/004 229/117.15

(Continued)

FOREIGN PATENT DOCUMENTS

GB 1261089 A 1/1972

OTHER PUBLICATIONS

International Search Report issued in PCT/US2022/014465, mailed Jun. 24, 2022.

*Primary Examiner* — Bryon P Gehman
(74) *Attorney, Agent, or Firm* — Brian J. Goldberg; Rohini K. Garg

(57) ABSTRACT

A tray includes a first outer side wall, a bottom wall hingedly attached to the first outer side wall, a second outer side wall hingedly attached to the bottom wall, a first inner side wall coupled to the first outer side wall by a first plurality of connecting segments defining at least a first container receptacle, and a second inner side wall coupled to the second outer side wall by a second plurality of connecting segments defining at least a second container receptacle.

18 Claims, 17 Drawing Sheets

(52) U.S. Cl.
CPC ..... *B65D 2571/00339* (2013.01); *B65D 2571/00487* (2013.01); *B65D 2571/0066* (2013.01); *B65D 2571/00716* (2013.01); *B65D 2571/00932* (2013.01)

(58) Field of Classification Search
CPC ..... B65D 2571/00339; B65D 2571/00487; B65D 2571/0066; B65D 2571/00716; B65D 2571/00932
USPC ..... 206/194, 198
See application file for complete search history.

(56) References Cited

U.S. PATENT DOCUMENTS

| | | | | |
|---|---|---|---|---|
| 2,559,948 | A * | 7/1951 | Currie | B65D 71/20 229/117.15 |
| 2,711,843 | A * | 6/1955 | Van Rosen | B65D 71/0029 206/189 |
| 2,828,047 | A | 3/1958 | Weiselberg | |
| 4,049,116 | A * | 9/1977 | Cope | B65D 71/0037 206/196 |
| 4,398,631 | A * | 8/1983 | Graser | B65D 71/0051 206/427 |
| 6,202,836 | B1 | 3/2001 | Picciolo | |
| 6,321,906 | B1 * | 11/2001 | Wein | B65D 71/0022 206/427 |
| 7,337,897 | B2 * | 3/2008 | Sutton-Rainey | B65D 71/16 206/199 |
| 2004/0118707 | A1 | 6/2004 | Sutton-Rainey et al. | |

* cited by examiner

TRAYS, PALLETIZED TRAY, BLANKS AND METHOD FOR FORMING A TRAY

CROSS REFERENCE TO RELATED APPLICATIONS

This application is a U.S. 371 National Phase Patent Application of International PCT Patent Application No. PCT/US2022/014465, filed on Jan. 29, 2022, which application claims the benefit of priority to U.S. Provisional Patent Application No. 63/143,685, filed on Jan. 29, 2021. The entire contents of these applications are incorporated herein by reference in their entirety.

BACKGROUND

Technological Field

The present disclosure relates to a blank for forming an article-carrying tray, and more specifically to a collapsible tray having a simple erecting procedure.

Description of Related Art

Foldable trays are commonly used in the food and beverage industry to transport prepared foods and beverages. Such cartons are typically distributed as planer cutouts, or blanks, that can be folded together at the site of the food preparation. Among the advantages of designing the carton to be assembled from a foldable blank is that the blanks are simple to manufacture and can be easily distributed and stored in a stacked or palletized relationship.

Desirably, the folding sequence necessary to assemble the carton from the blank should be quick and simple to perform. Additionally, the blank should be provided as a unitary piece that does not require additional parts to produce the assembled carton on site. The carton should be assembled in a manner that prevents the carton from unintentionally unfolding. Typical trays are commonly of a unitary size and require items placed in the trays to be of a particular size as well, otherwise products can move within the tray.

The conventional methods and systems have generally been considered satisfactory for their intended purpose. However, there is still a need in the art for a blank and a tray that is simple to erect and collapse. Further, it is preferable that these trays can at least be partially constructed at a manufacturer before being shipped to an end user to be erected. It would also be preferable if the initial construction and shipments required less steps than typical trays require today. There also remains a need in the art for such blanks and trays that are economically viable. The present disclosure may provide a solution for at least one of these remaining challenges, and provide a tray for accommodating one or more articles of various sizes, for example drinks, beverages, cans, cups, or the like, formed from a blank of paperboard or suitable foldable sheet material.

SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

A tray includes a first outer side wall, a bottom wall hingedly attached to the first outer side wall, a second outer side wall hingedly attached to the bottom wall, a first inner side wall coupled to the first outer side wall by a first plurality of connecting segments defining at least a first container receptacle, and a second inner side wall coupled to the second outer side wall by a second plurality of connecting segments defining at least a second container receptacle. The tray can also include an end tab coupled to the bottom wall and foldably coupled to the first inner side wall, a handle comprising a portion of the second inner wall, and at least one tab coupled to each of the outer side walls configured to secure a container within a container receptacle.

The first inner wall and the second inner wall can be coupled in a face-to-face relationship, wherein the first inner wall and the second inner wall are flush and partially overlap. The handle portion can include two plies, and each cross section includes a maximum of four plies.

A palletized tray includes a first layer including a portion of a base section of the tray and a first outer side wall of the tray, a second layer including a first plurality connecting segments coupling the first outer wall and the first inner wall, a third layer including at least a portion of a handle of the tray and a second plurality of connecting segments coupling the handle to the base section of the tray. The palletized tray in erected state can include at least a bottom wall hingedly attached to the first outer side wall and a second outer side wall hingedly attached to the bottom wall.

A blank to form an erected tray includes a base section extending along a lateral axis, a first lateral section foldably coupled to the base section, a first end section coupled to the first lateral section, an end tab foldably coupled to the first end section, a second lateral section foldably coupled to the base section, a second end section coupled to the second lateral section and a handle tab foldably coupled to the second end section. A length from a first end to the base section can be less than one third of a length from the first end to a second end of the blank. The blank can include a coated side and an uncoated side. Each of the first and second lateral sections can include a tab coupled thereto to retain a portion of a container within the erected tray. The base section of the blank can include a plurality of base cutouts formed therein, each of the plurality of base cutouts configured to receive a portion of a respective article to be held in the erected tray. The first blank can include a plurality of connecting segments, each of the plurality of connecting segments foldably coupled to one of the lateral sections and one of the end sections, the plurality of connecting segments being configured to form article retainers when erected, wherein each of the connecting segments comprises at least one arcuate side configured to engage a container placed within the carrier.

The end tab can include a glue strip configured to couple the end tab to the base section. The second end section or the handle tab can include at least one glue strip configured to attach the second end section and the handle tab in a face-to-face relationship. The handle tab can include at least one glue strip configured to couple the handle tab to the first end section in a face to face relationship when erected. The second end section can include a foldable portion configured to be coupled to a window within the handle tab.

A method of forming a tray include folding a first end of a blank away from a first side of the blank, gluing the first side the first end of the blank to the first side of a base section of the blank, folding a second end of the blank to form a face-to-face relationship between the first side of a second end of the blank and an intermediate portion of the blank, an gluing a second side of the second end of the blank to form a face-to-face relationship between the second side of the second end of the blank and a second side of the first end of the blank to form a tray. The method can include collapsing the tray to form a palletized tray to form a minimum of two-plie layers and a maximum of four-plie layers and stacking multiple palletized trays in order to produce a package of trays.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION

Figure 1:
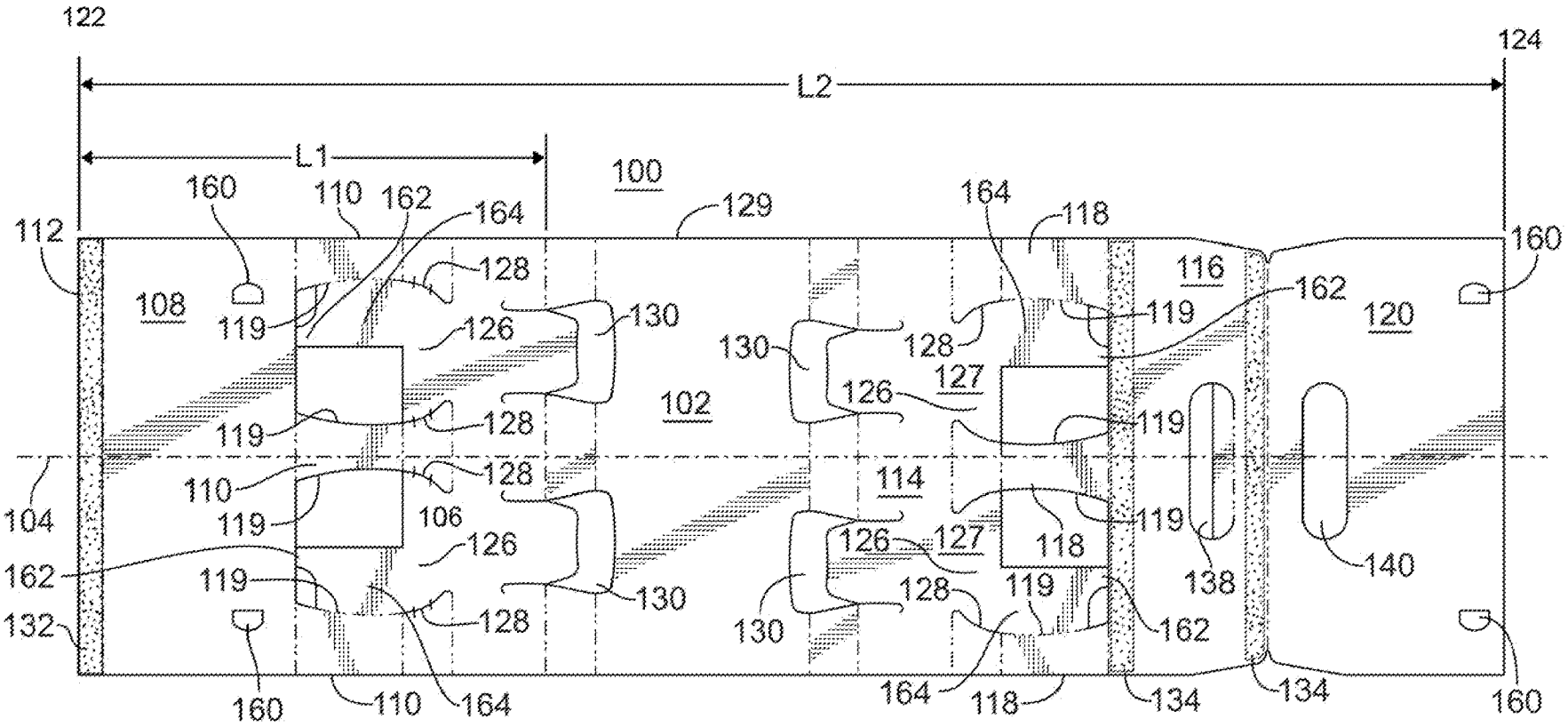
FIG. 1 is a plan view of a blank of the present disclosure.

Reference will now be made to the drawings wherein like reference numerals identify similar structural features or aspects of the subject invention. For purposes of explanation and illustration, and not limitation, a partial view of an example of a tray in accordance with the invention is shown in FIG. 1 and is designated generally by reference character 100. Other examples of the tray in accordance with the invention, or aspects thereof, are provided in FIGS. 2-18, as will be described. The methods and systems of the invention can be used to provide a blank that can be easily folded into a tray that allows the transport and accommodation of articles, such as drink containers of various sizes, in a secure and covered arrangement, while also providing a simple method of erecting and collapsing the tray.

FIG. 1 shows a plan view of a blank 100 of the present disclosure. The blank 100 includes a coated side and an uncoated side. The blank 100 includes a base section 102 extending along a lateral axis 104, a first lateral section 106 foldably coupled to the base section 102, a first end section 108 coupled to the first lateral section 106 by a first plurality of connecting segments 110, an end tab 112 foldably coupled to the first end section 108, a second lateral section 114 foldably coupled to the base section 102 opposite the first lateral section 106, a second end section 116 coupled to the second lateral section 114 by a second plurality of connecting segments 118, and a handle tab 120 foldably coupled to the second end section 116. Each of the connecting segments 110/118 include at least one arcuate side 119 which engages a container placed within the carrier receptacles 121 (shown in FIG. 5) and helps ensure that a container is secured laterally. The base section 102 further includes a plurality of base cutouts 130 which are configured to receive a portion of an article or container, such as a cup, can, bottle, or the like, and helps maintain the container's position within an erected tray.

The ratios and geometry of the blank 100 allow the blank to be folded and erected into a palletized tray which has a more uniform thickness across the length of the palletized tray. One of the geometric ratios includes a length (L1) from a first end 122 of the blank to a first end of the base section 102 being less than one third of a length (L2) from the first end 122 of the blank to a second end of the blank 124. FIG. 1 further shows each of the first 106 and second lateral sections 114 include a tab 126/127 coupled thereto by partially perforated boundaries 128. Each of tabs 126/127 is used to retain a portion of a container within the erected tray. The tabs 126 may be offset from their corresponding counterparts' tabs 127. Tabs 126 may be closer to a first edge 129 than tabs 127, and as a result, the corresponding receptacles of the erected container may also be offset from each other. This prevents the outermost portions of the containers held in the erected tray from butting-up against each other and provides a more compact and secure fit within the erected tray.

Figure 5:
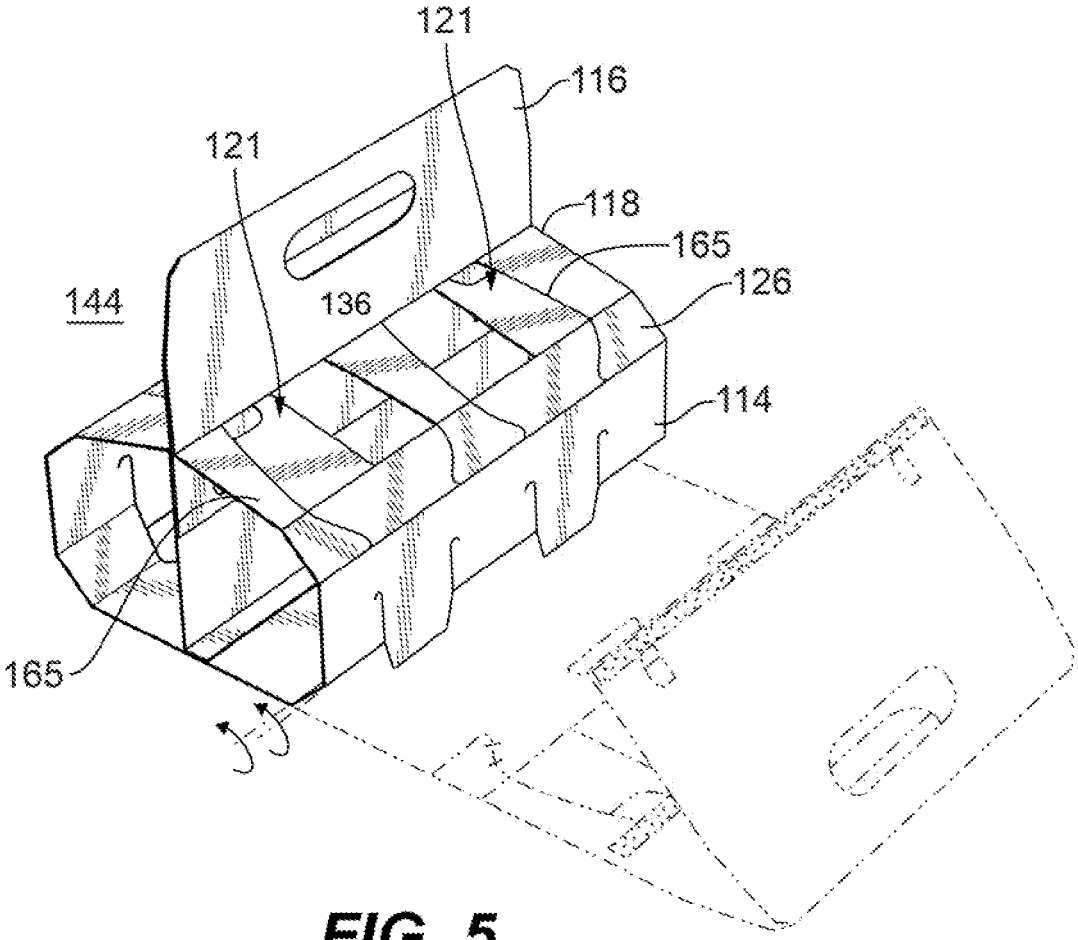
FIG. 5 is a perspective view of the blank of FIG. 1, showing a fourth folding step and a fully erected tray.

FIG. 1 further shows a glue strip 132 on the first end tab 112 configured to couple the first end section 108 to the base section 102 at about the mid-point of the base section 102. The second end section 116 or the handle tab 120 includes two glue strips 134 to attach the second end section 116 and the handle tab 120 in a face-to-face relationship and form a handle portion 136 (as shown in FIG. 5). The second end section 116 also includes a foldable portion 138 to be coupled to a window 140 within the handle tab 120 when the two are in a face-to-face relationship, helping ensure a thick and sturdy handle portion 136 for carrying the tray.

Figure 2:
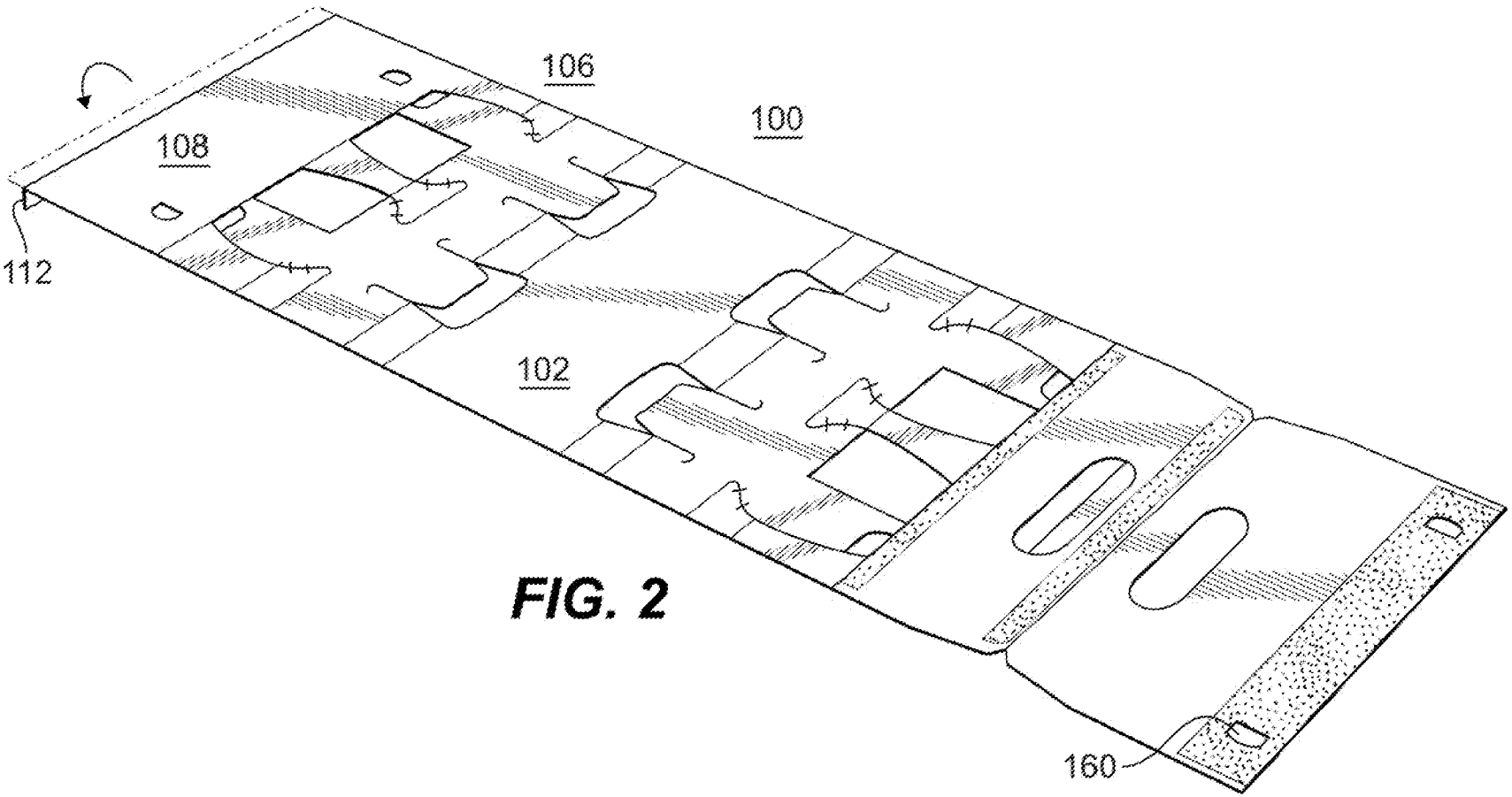
FIG. 2 is a plan view of the blank of FIG. 1, showing a first folding step.
Figure 3:
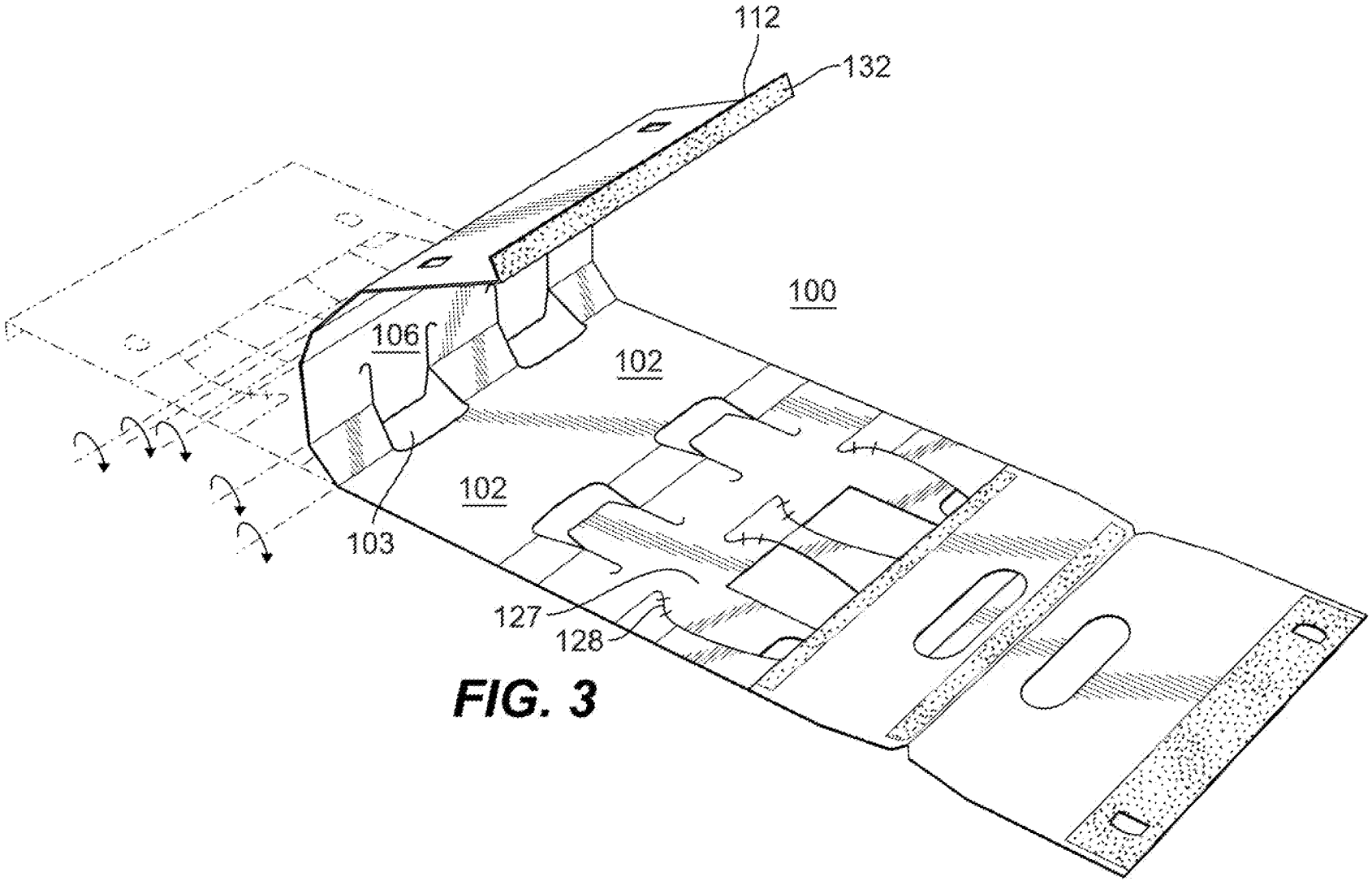
FIG. 3 is a perspective view of the blank of FIG. 1, showing a second folding step.
Figure 4:
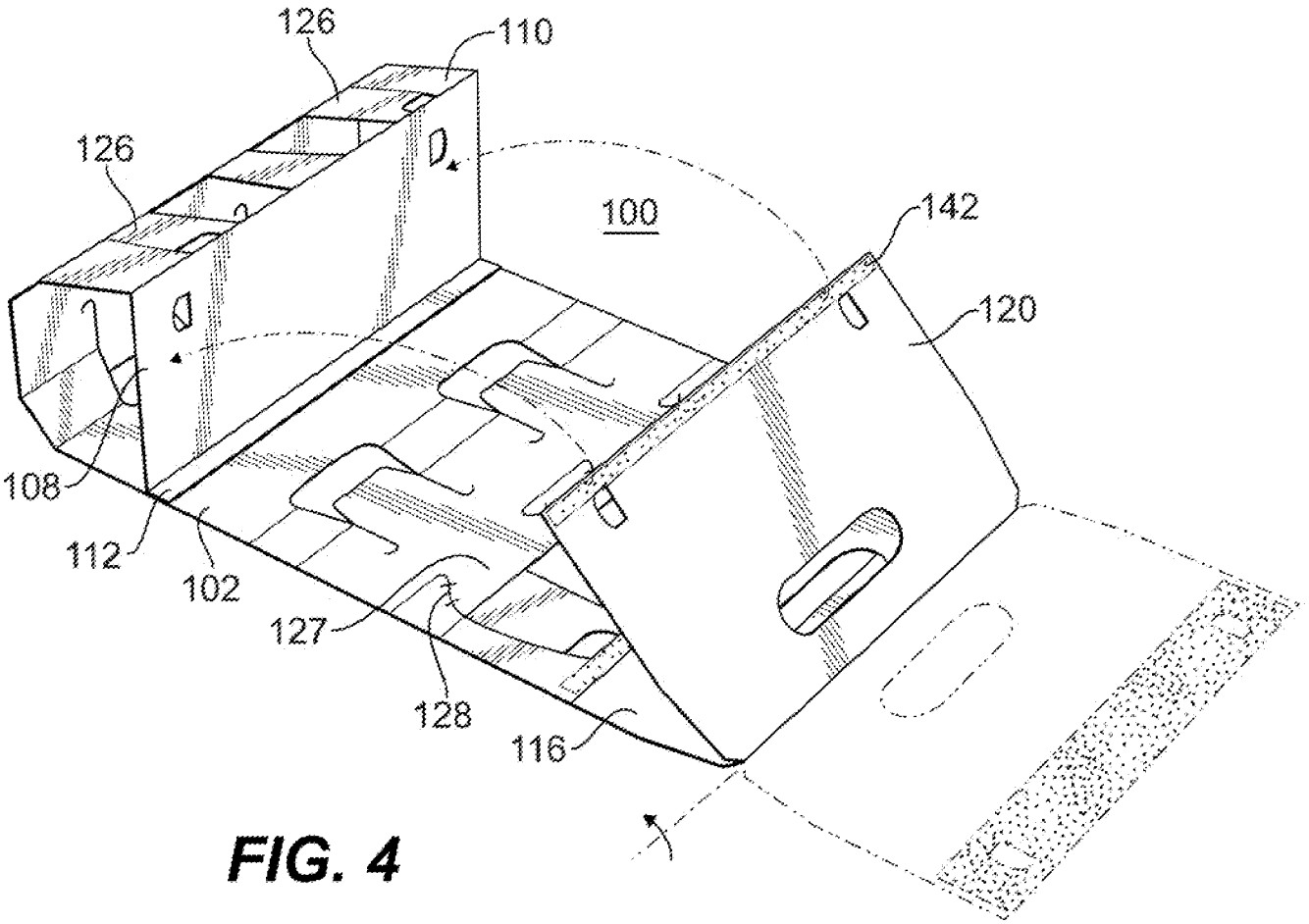
FIG. 4 is a perspective view of the blank of FIG. 1, showing a third folding step.

FIG. 2 shows a plan view of the blank 100 with the first folding step folding the first end tab 108 away from the uncoated side of the blank 100 in order to form an angle with the first end section 108. The first end section 108 then gets folded and the first end tab 112 is glued to the coated side of the base section 102 as shown in FIGS. 3 and 4. The tabs 126 may separate along their perforated lines 128 upon folding. FIGS. 4 and 5 show a step of folding the handle tab 120 to form a face-to-face relationship with an intermediate portion of the blank, and specifically including the second end section 116. This exposes a glue strip 142 (shown in FIG. 4) located on the coated side of the handle tab 120. This glue strip 142 is used to glue the coated side of the handle tab 120 to form a face-to-face relationship with the coated side of the first end section 108 and form an erected tray 144. FIG. 5 shows a fully erected tray.

Figure 6:
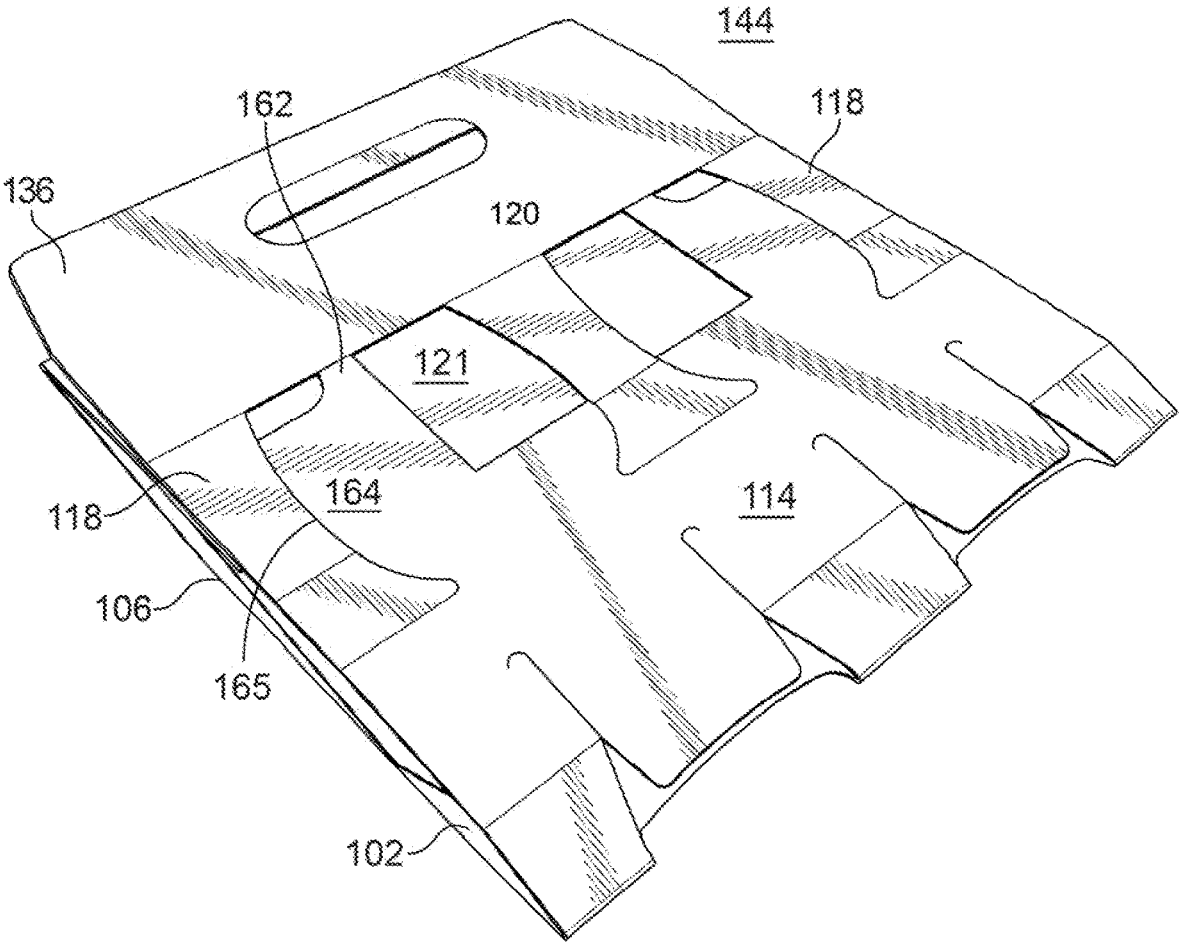
FIG. 6 is a perspective view of the tray of FIG. 5, showing a collapsed tray.

FIG. 6 shows the tray 144 in a collapsed or palletized state. The handle portion 136 includes two plies, and each layer or cross section of the tray includes a maximum of four plies. The palletized tray 144 includes a bottom or first layer having a single plie which includes a portion of base section 102 and the first outer side wall of the tray defined by the first lateral section 106. The palletized tray 144 further includes a second layer which is made up of the first plurality connecting segments 110 and the first the first end tab 108 (not seen in FIG. 6) and a third or top layer including at least a portion of the handle tab 120 and the second plurality of connecting segments 118.

Figure 7:
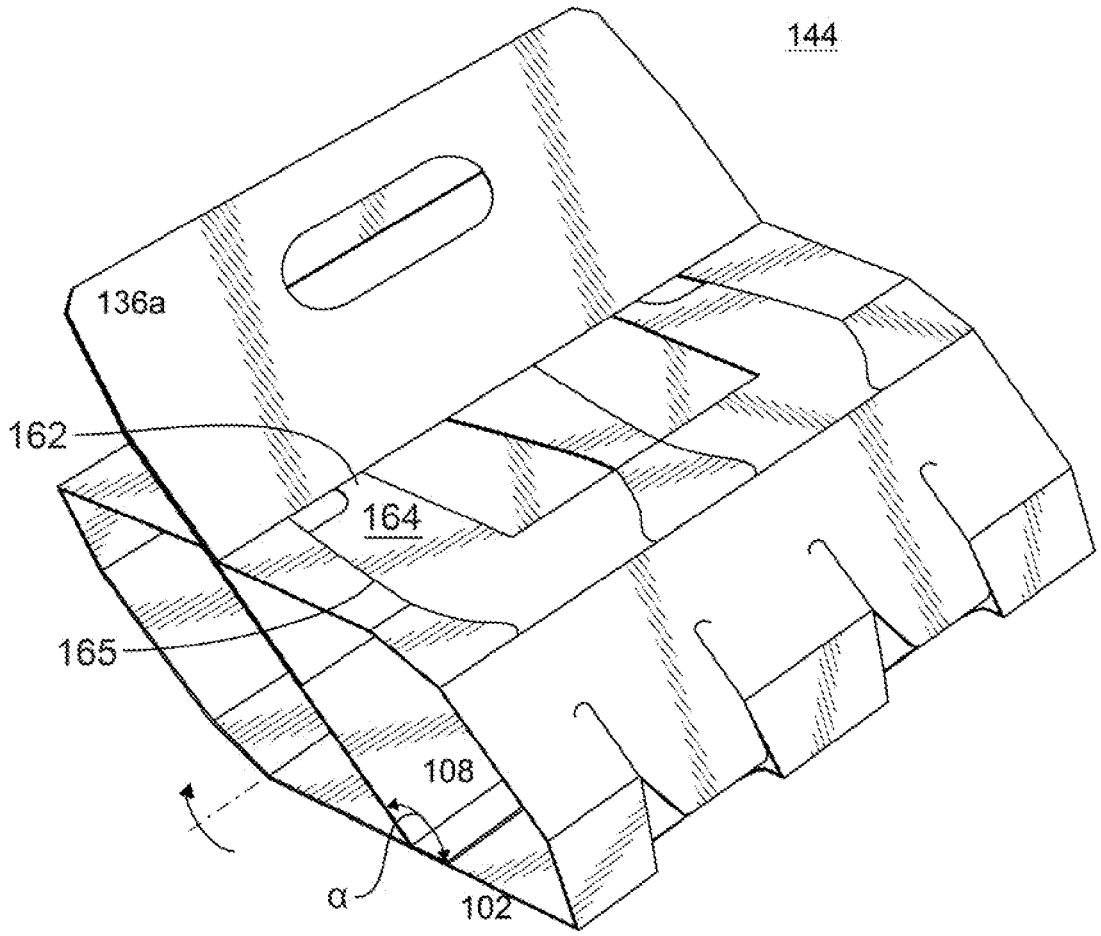
FIG. 7 is a perspective view of the tray of FIG. 5, showing a tray in a partially erected position.

FIG. 7 shows an intermediate step of unfolding the palletized tray 144, in order to prepare it for use by an end user or customer. When a customer or end user receives a set of palletized trays as shown in FIG. 6, each of the trays 144 need to be erected for use. In order to erect each tray 144, the overhanging over the second layer of the palletized tray of FIG. 6 portion of the handle **136*a* is pressed up from a horizontal position as shown in FIG. 6, past a vertical point such that the overhanging portion of the handle 136*a* points at a diagonal direction with respect to the base section 102 forming an angle (a). The angle (a) between the first end tab 108 and the base section 102 becomes obtuse. Afterwards, the customer or end user moves the overhanging portion of the handle 136*a*** back to the vertical position allowing the tray to stay erect when one or more containers are placed therein.

Figure 8:
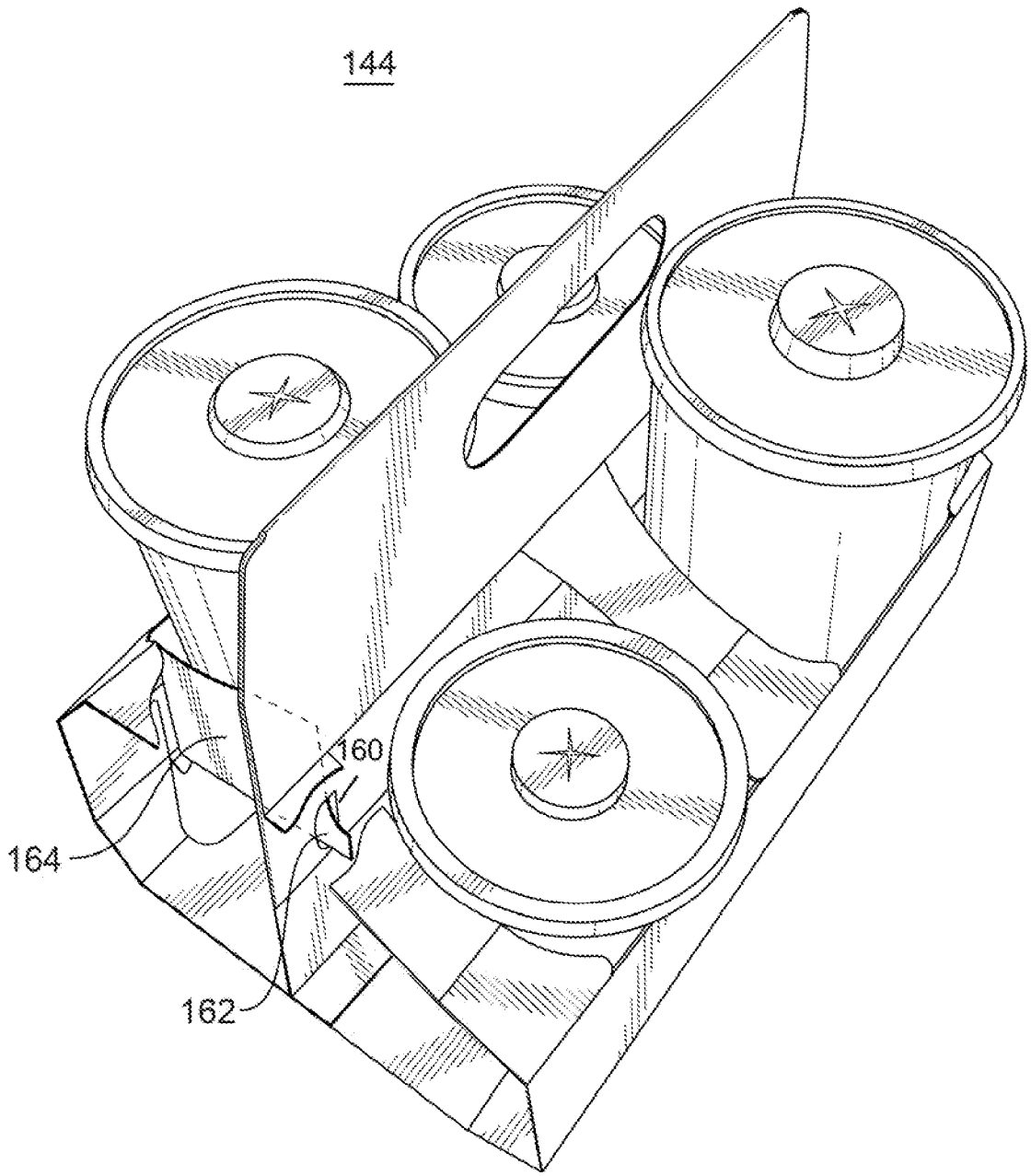
FIG. 8 is a perspective view of the tray of FIG. 5, showing tray with containers.
Figure 9:
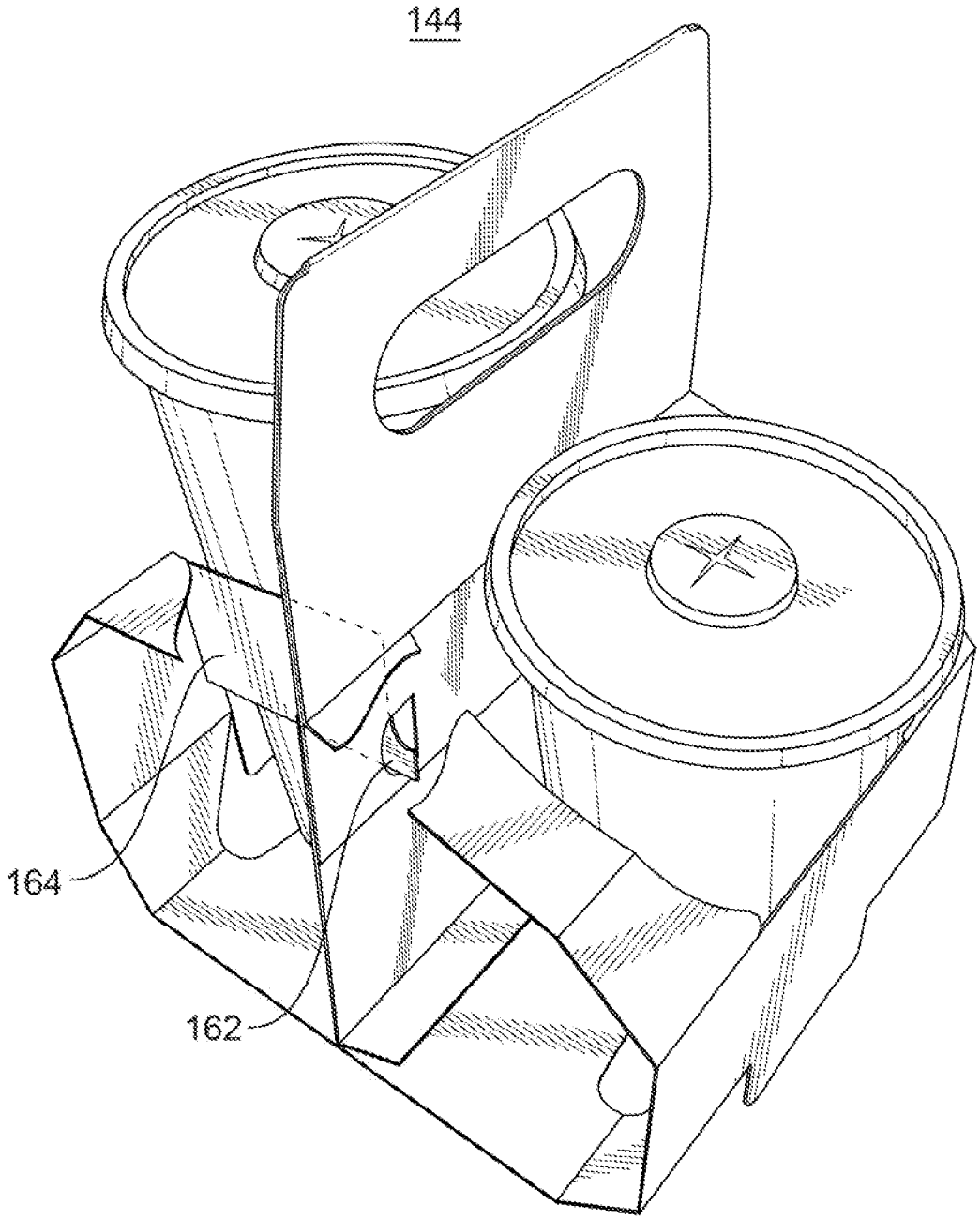
FIG. 9 is a perspective view of a version of the tray of FIG. 5, showing a two-container tray.

FIG. 8 shows a 2 by 2 arrangement of tray 144 with containers in place while FIG. 9 shows a possible 1 by 2 arrangement where the ratios and geometries of the blank along the longitudinal axis 104 are the same as the 2 by 2 arrangement. Further shown in FIG. 8 are flaps 164 which include a locking tab 162. Each of the locking tabs 162 is configured to fit into a corresponding opening 160 when the tray 144 is erected. Flaps 164 are pressed downward by a container when the container is inserted into the receptacle 121.

Figure 10:
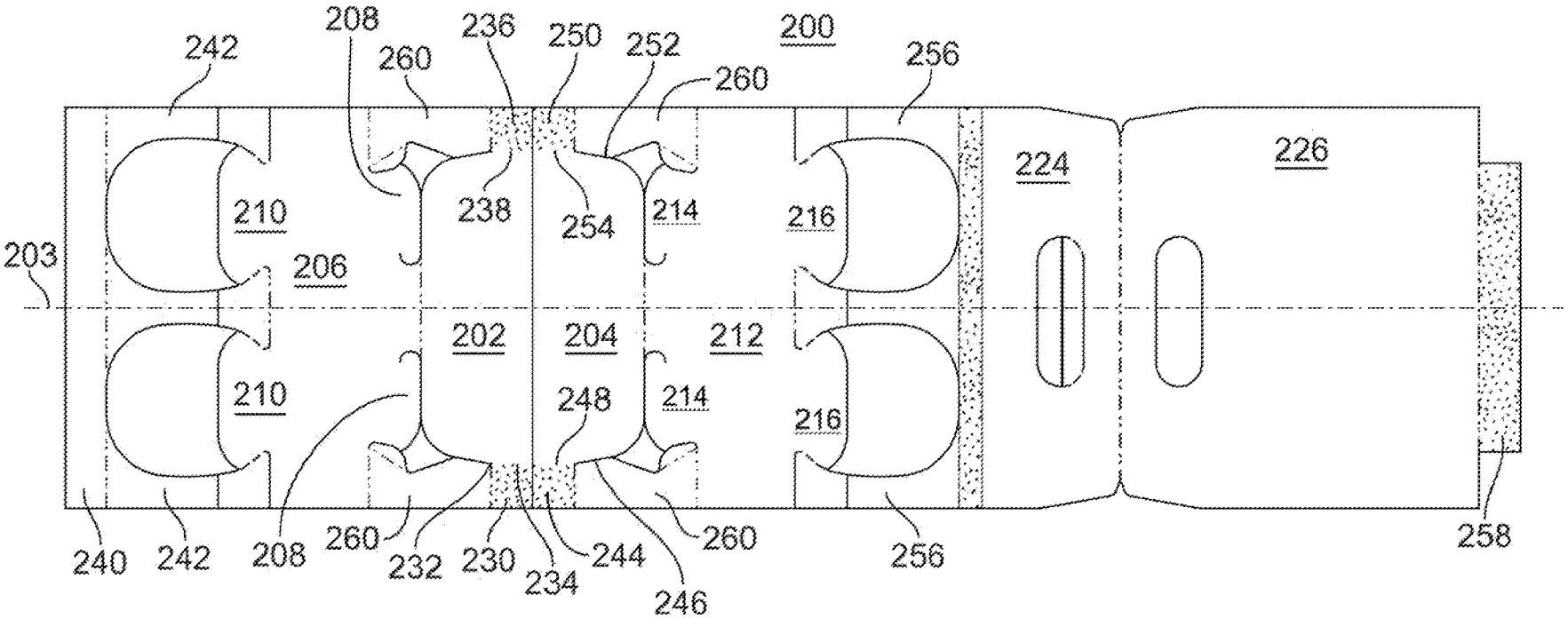
FIG. 10 is a plan view of another blank of the present disclosure.
Figure 11:
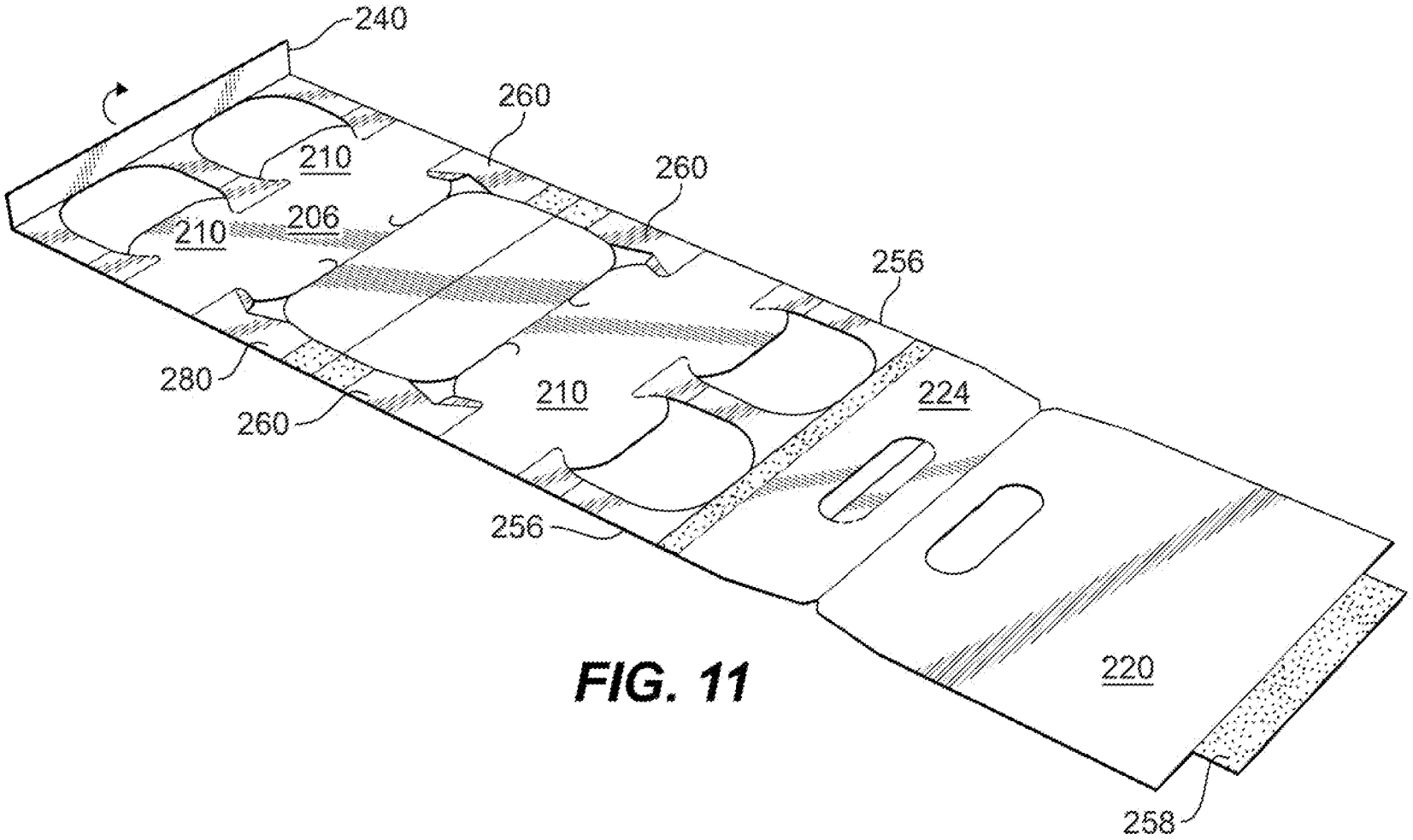
FIG. 11 is a plan view of the blank of FIG. 10, showing a first folding step.

FIG. 10 shows a series of other features that could be used in a blank 200 for constructing a tray. The blank 200 includes a first base section 202 defining a longitudinal axis 203 a first glue section 230 coupled to a first side 232 of the first base section 202 by a perforated connection 234 and a second glue section 236 coupled to a second side of the first base section by a perforated connection 238. A first outer section 206 including a first inner tab 208 is hingedly coupled to the first base section 202 and a first outer tab 210. A second outer section 212 including a second inner tab 214 is hingedly coupled to the second base section 204 and a second outer tab 216. The blank 200 further includes a first end glue tab 240 hingedly coupled to the first outer section 206 by a first pair of connecting segments 242. A third glue section 244 is coupled to a first side 246 of the second base section 204 by a perforated connection 248 and a fourth glue section 250 is coupled to a second side 252 of the second base section 204 by a perforated connection 254. The blank 200 further includes a first handle section 224 hingedly coupled to the first outer section 206 by a second pair of connecting segments 256, and a second handle section 226 hingedly coupled to the first handle section 224 and a second end glue tab 258 hingedly coupled to the second handle section 226. Each of the base sections 202/204 is connected to a corresponding outer section 206/212 by a corresponding plurality of connectors 260 in order to provide lateral support for a lower portion of a container held in the tray when the blank is erected to a tray.

Figure 12:
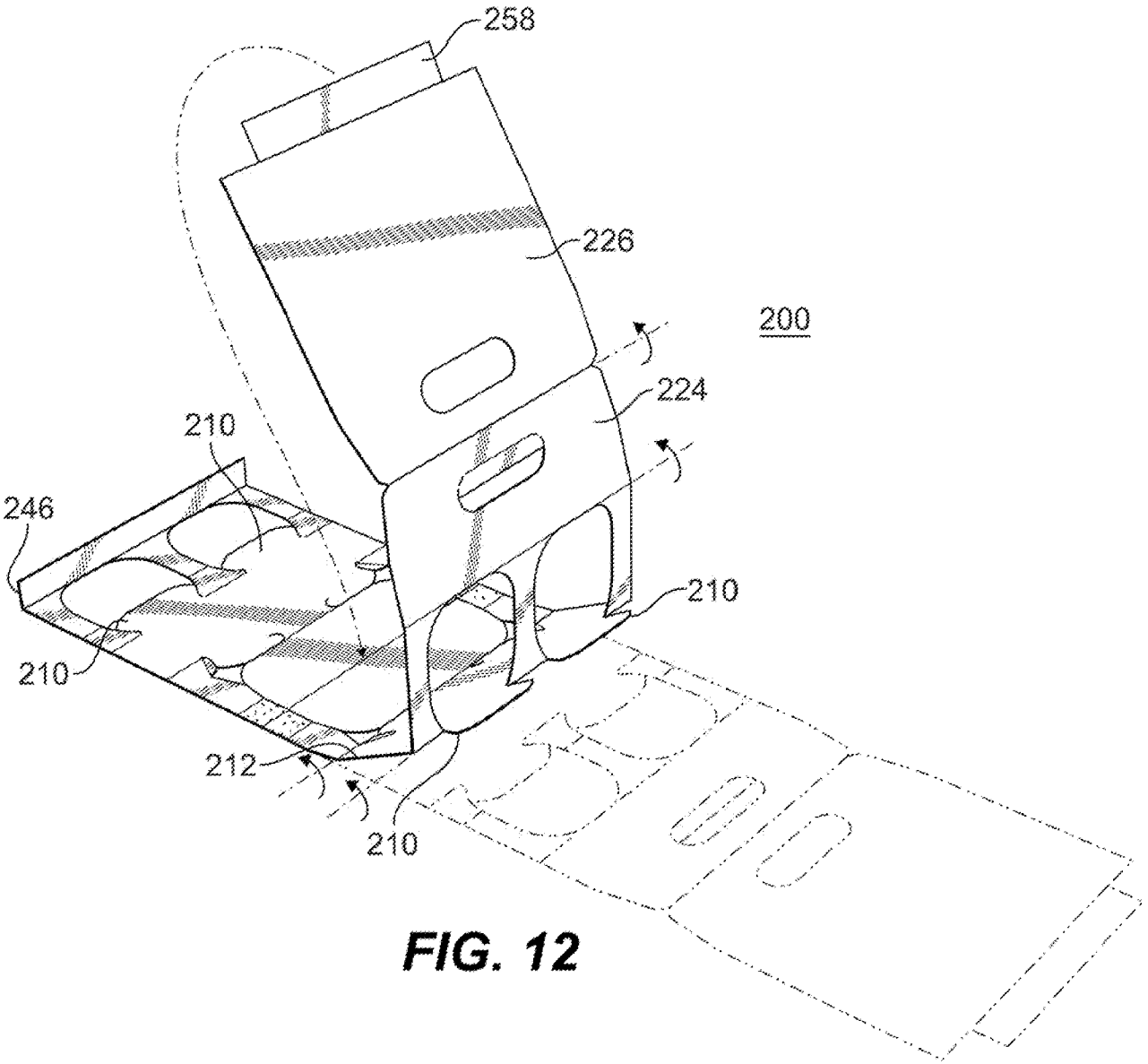
FIG. 12 is a perspective view of the blank of FIG. 10, showing a second folding step.
Figure 13:
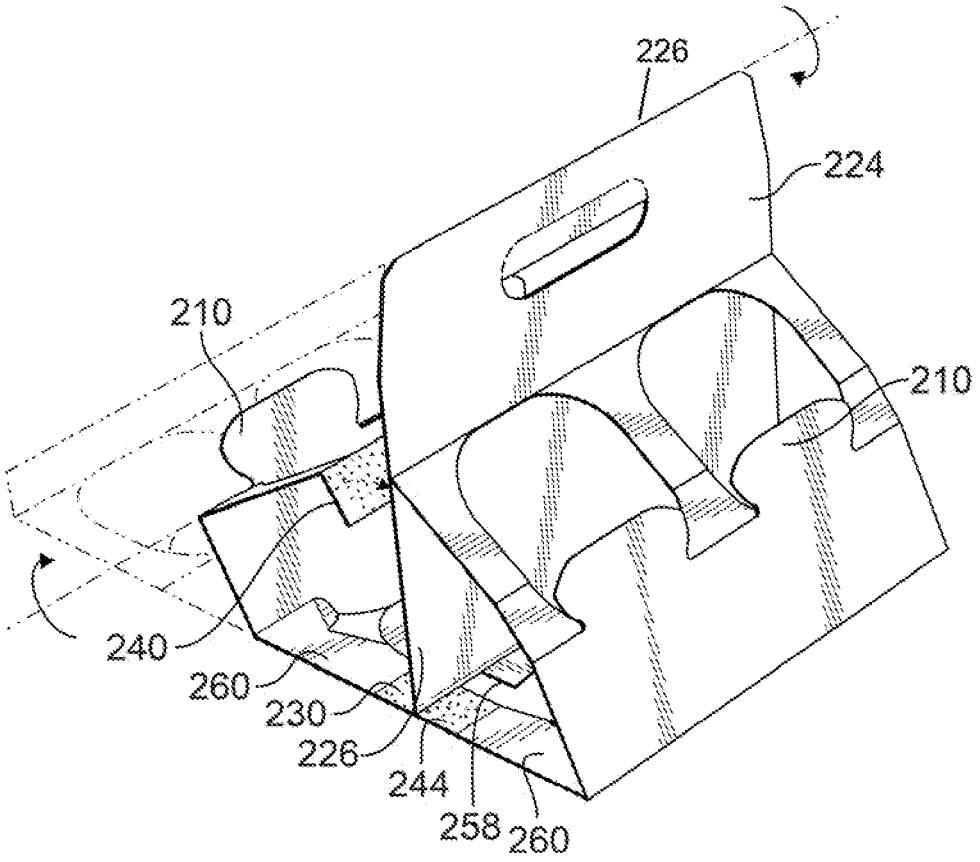
FIG. 13 is a perspective view of the blank of FIG. 10, showing a third folding step.
Figure 14:
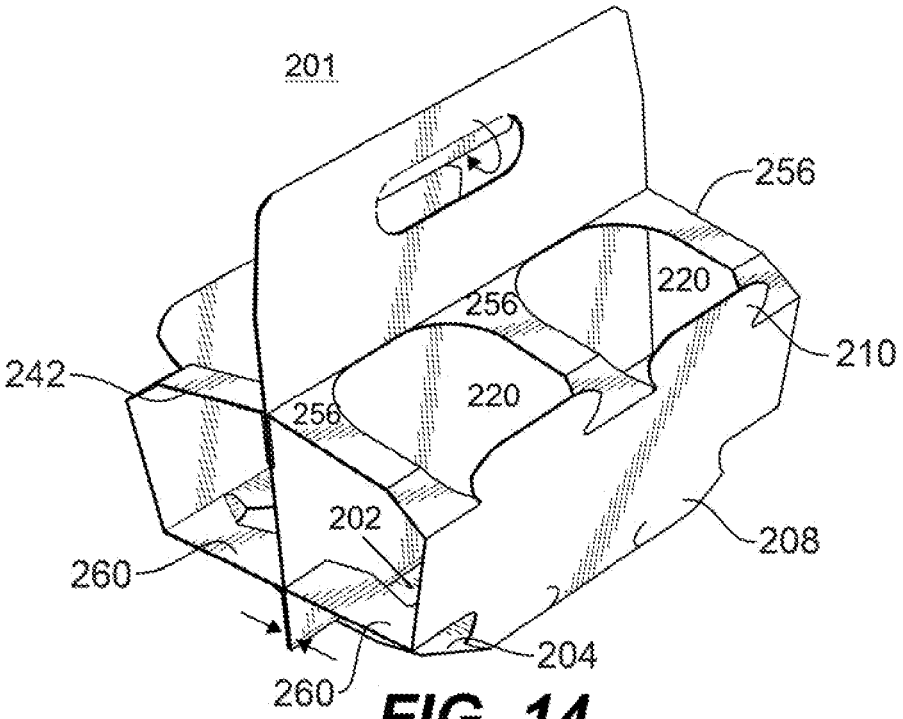
FIG. 14 is a perspective view of the blank of FIG. 10, showing a fourth folding step and a fully erected tray.

FIGS. 11-14 show a process of erecting the tray from the blank 200. The first step, shown in FIG. 11, includes folding the first end glue tab 240 inward, such that it is pointing up. FIG. 12 shows the first handle section 224, the second outer section 212, and the second handle section 226 being lifted and folded up towards the center of the blank. The second end glue tab 258 is then glued to the center of the blank 200, as shown in FIG. 13, forming a two-plie handle when the first end glue tab 240 is then glued to the back side of the second handle section 226. FIG. 14 shows the erected form of the tray 201 includes the first base section 202 to support the bottom of a first container and the second base section 204 hingedly coupled to the first base section 202 to support the bottom of the second container. The tray includes the first outer section 206 including the first inner tab 208, which secures the lower portion of the first container held in the tray, and which is hingedly coupled to the first base section 202 and the first outer tab 210 which contacts an upper portion of the container held in the tray. The second outer section 212 includes the second inner tab 214, which contacts the lower portion of the second container held in the tray and is hingedly coupled to the second base section 204 and the second outer tab 216 to help secure an upper portion of the second container held in the tray. The tray 201 further includes two pluralities of connecting segments 256/242. The first outer tab 210 is located between two adjacent connecting segments 256. The connecting segments 256 define an opening 220 where the first container can be inserted.

The tabs 208/210 allow for a more secure holding of the containers, providing back and front support, whereas the connectors 260/256 provide lateral support, by allowing the base section 204 to drop to a lower level and contact the containers at a point between the base section 204 and the insertion points of the containers.

Figure 15:
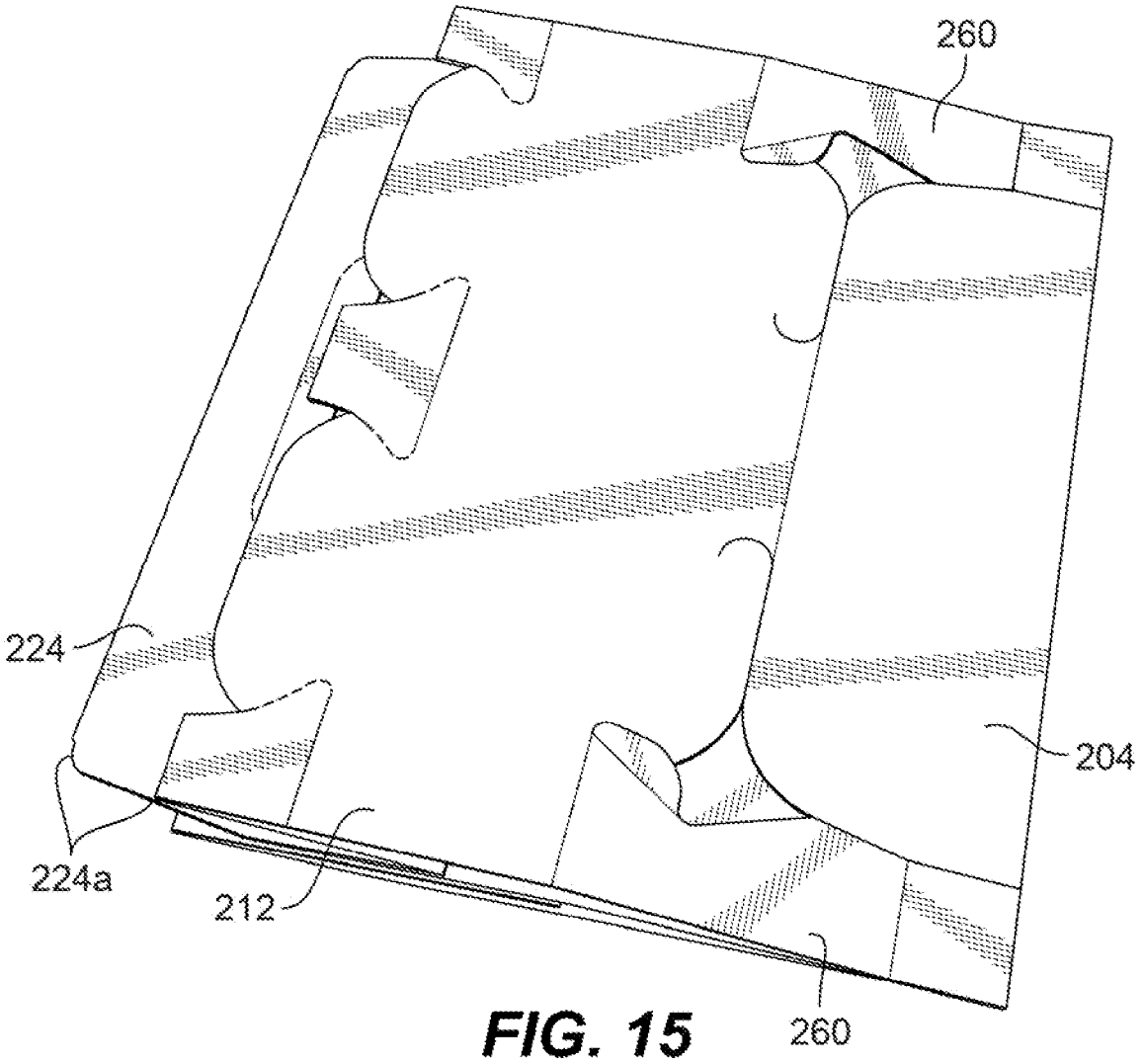
FIG. 15 is a perspective view of the tray of FIG. 14, showing a collapsed tray.
Figure 16:
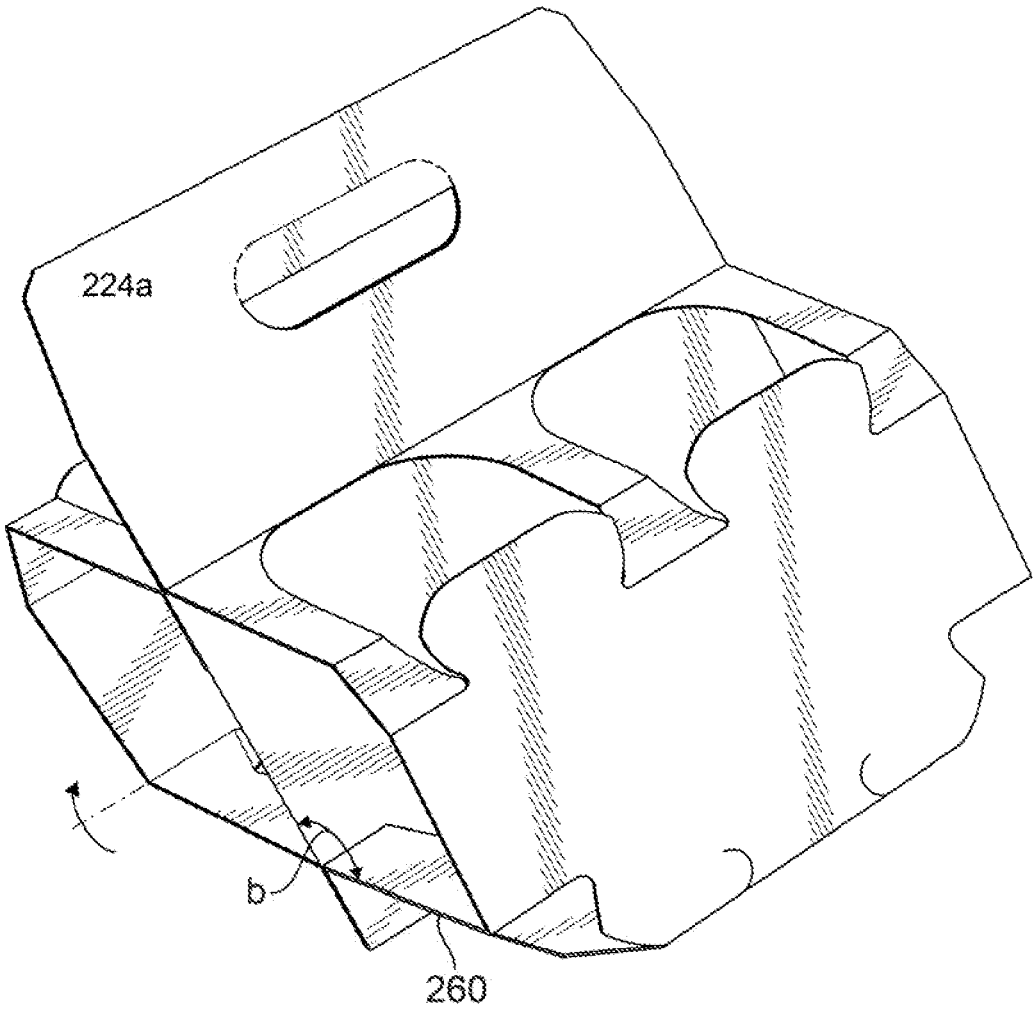
FIG. 16 is a perspective view of the tray of FIG. 14, showing a tray in a partially erected position.

FIG. 16 shows an intermediate step of unfolding a palletized tray, in order to prepare it for use by an end user or customer. When a customer or end user receives a set of palletized trays as shown in FIG. 15, each of the trays 201 need to be erected for use. In order to erect each tray 201, the overhanging portion of the handle **224*a* is pressed up from a horizontal position as shown in FIG. 16, past a vertical point such that the overhanging portion of the handle 224*a* points at a diagonal direction with respect to the base section 102 forming an angle (b). The angle (b) becomes obtuse. Afterwards, the customer or end user moves overhanging portion of the handle 224*a*** back to the vertical position allowing the tray to stay erect when one or more containers are placed therein.

Figure 17:
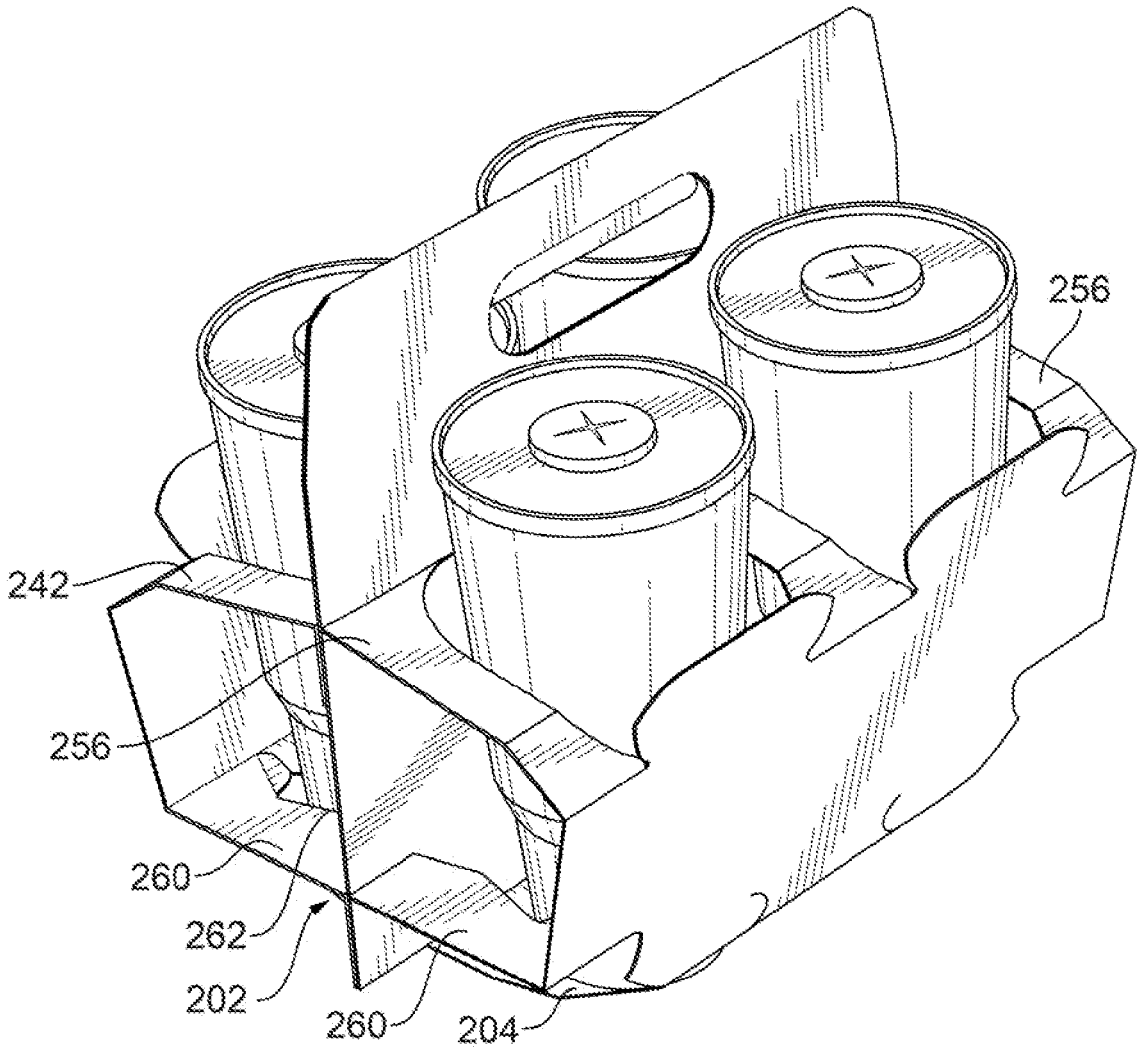
FIG. 17 is a perspective view of the tray of FIG. 14, showing tray with containers.
Figure 18:
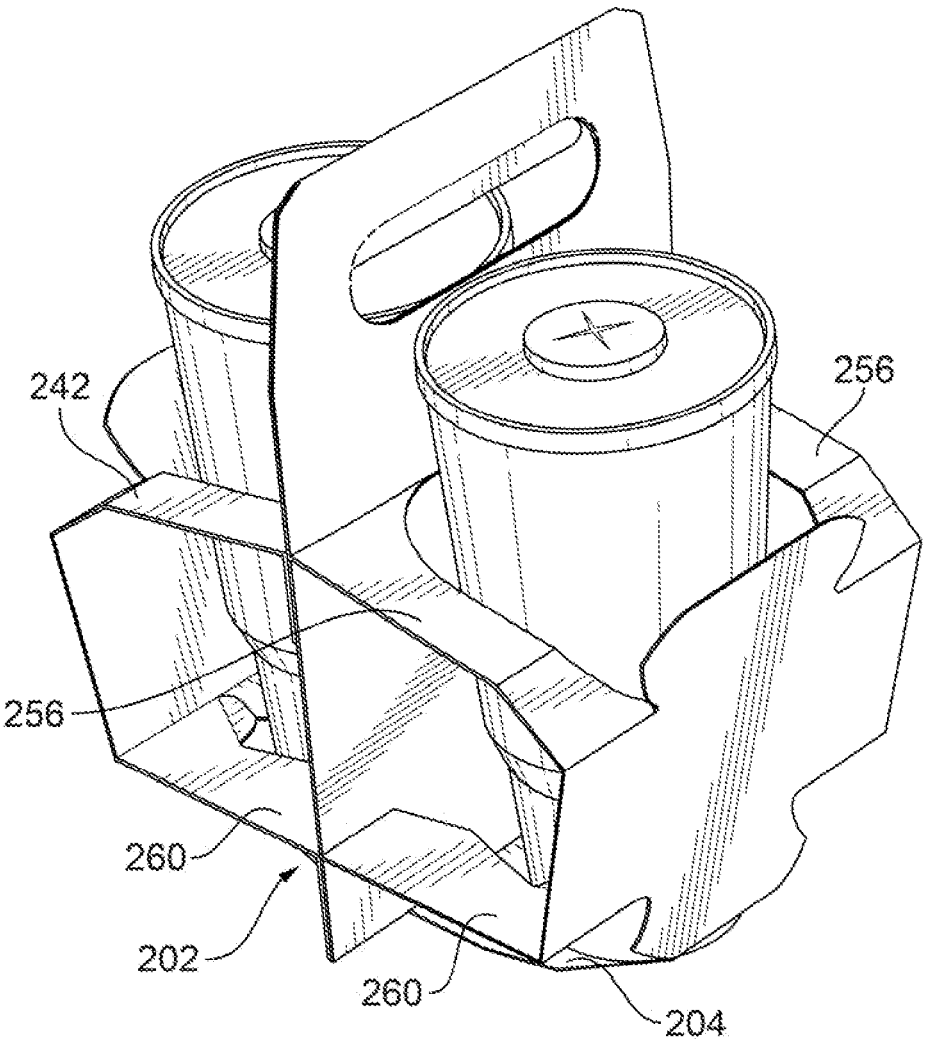
FIG. 18 is a perspective view of a version of the tray of FIG. 14, showing a two-container tray.

FIG. 17 shows a 2 by 2 arrangement while FIG. 18 shows a possible 1 by 2 arrangement where the ratios and geometries of the blank would be the same as the 2 by 2 arrangement. Each of the base sections 202/204 is shown connected to the corresponding outer section 206/210 by a corresponding plurality of connectors 260 in order to provide lateral support for a lower portion of a container when the blank is erected to a tray, and the second pair of connecting segments 256 connects the outer section 206/210 to the central portion.

The methods and systems of the present disclosure, as described above and shown in the drawings, provide for a tray and blank for forming the tray with superior properties including increased strength, ease of assembly and adaptability to different sized articles held therein. The tray further provides a simple manufacturing method. The relative thicknesses of each layer of the tray in a palletized state allow for a more even packaging of multiple trays. Typically trays have to be turned during packaging in order to prevent bowing and sagging of packaged trays to one side. The geometries and erecting methods described above prevent bowing and sagging of packages to one side and allow packaging to turn the trays less often. While the apparatus and methods of the subject disclosure have been shown and described with reference to certain examples, those skilled in the art will readily appreciate that changes and/or modifications may be made thereto without departing from the spirit and score of the subject disclosure.

What is claimed:

1. A tray comprising: a first outer side wall; a bottom wall hingedly attached to the first outer side wall; a second outer side wall hingedly attached to the bottom wall; a first inner side wall coupled to the first outer side wall by a first plurality of connecting segments defining at least a first container receptacle; and a second inner side wall coupled to the second outer side wall by a second plurality of connecting segments defining at least a second container receptacle.

2. The tray of claim 1, further comprising an end tab coupled to the bottom wall and foldably coupled to the first inner side wall.

3. The tray of claim 1, further comprising a handle comprising a portion of the second inner wall.

4. The tray of claim 1, further comprising at least one tab coupled to each of the first and second outer side walls, the at least one tab configured to secure a container within a respective container receptacle.

5. The tray of claim 1, wherein the first inner wall and the second inner wall are coupled in a face-to-face relationship.

6. The tray of claim 5, wherein the first inner wall and the second inner wall are flush and at least partially overlap.

7. The tray of claim 1, further comprising a handle portion, wherein the handle portion comprises two plies.

8. The tray of claim 1, wherein the tray is configured to be collapsible into a palletized form and wherein in the palletized form, a handle portion extends past a remaining portion of the tray.

9. The tray of claim 1, wherein the tray, in a palletized state, comprises: a first layer including a portion of a base section of the tray and the first outer side wall of the tray; a second layer including the first plurality connecting segments coupling the first outer wall and the first inner wall; and a third layer including at least a portion of a handle of the tray and the second plurality of connecting segments coupling the handle to the base section of the tray.

10. The tray of claim 9, wherein the tray, in an erected state, the bottom wall is hingedly attached to the first outer side wall; and the second outer side wall hingedly attached to the bottom wall.

11. A blank to form an erected tray, the blank comprising: a base section extending along a lateral axis; a first lateral section foldably coupled to the base section; a first end section coupled to the first lateral section; an end tab foldably coupled to the first end section; a second lateral section foldably coupled to the base section; a second end section coupled to the second lateral section; a handle tab foldably coupled to the second end section; and a plurality of connecting segments, each of the plurality of connecting segments foldably coupled to one of the lateral sections and one of the end sections, the plurality of connecting segments being configured to form article retainers when erected.

12. The blank of claim 11, wherein a length from a first end of the blank to a first end of the base section is less than one third of a length from the first end of the blank to a second end of the blank.

13. The blank of claim 11, wherein the blank comprises a coated side and an uncoated side.

14. The blank of claim 11, wherein the base section of the blank comprises a plurality of base cutouts formed therein, each of the plurality of base cutouts configured to receive a portion of a respective article to be held in the erected tray.

15. The blank of claim 11, wherein the plurality of connecting segments being configured to form article retainers when erected.

16. The blank of claim 11, wherein the end tab comprises a glue strip configured to couple the end tab to the base section.

17. The blank of claim 11, wherein: (i) the second end section comprises at least one glue strip configured to attach the second end section and the handle tab in a face-to-face relationship in the erected tray, or (ii) the handle tab comprises at least one glue strip configured either to attach the handle tab and the second end section in a face-to-face relationship in the erected tray or to couple the handle tab to the first end section in a face-to-face relationship in the erected tray.

18. The blank of claim 11, wherein the second end section comprises a foldable portion configured to be coupled to a window within the handle tab.

* * * * *